US006072280A

United States Patent [19]

Allen

[11] Patent Number: 6,072,280

[45] Date of Patent: Jun. 6, 2000

[54] LED LIGHT STRING EMPLOYING SERIES-PARALLEL BLOCK COUPLING

[75] Inventor: Mark R. Allen, LaJolla, Calif.

[73] Assignee: Fiber Optic Designs, Inc., Yardley, Pa.

[21] Appl. No.: 09/141,914

[22] Filed: Aug. 28, 1998

[51] Int. Cl.[7] ..... H05B 37/00

[52] U.S. Cl. ..... 315/185 S; 315/312; 315/324; 315/192

[58] Field of Search ..... 315/185 S, 323, 315/324, 325, 322, 192, 185 R, 294, 292, 295, 312

[56] References Cited

U.S. PATENT DOCUMENTS

| | | | |
|---|---|---|---|
| 4,675,575 | 6/1987 | Smith et al. | 315/185 |
| 4,984,999 | 1/1991 | Leake | 439/425 |
| 5,027,037 | 6/1991 | Wei | 315/200 |
| 5,404,282 | 4/1995 | Sasser et al. | 362/249 |
| 5,463,280 | 10/1995 | Johnson | 315/187 |
| 5,495,147 | 2/1996 | Lanzisera | 315/185 |
| 5,661,645 | 8/1997 | Hochstein | 363/89 |
| 5,726,535 | 3/1998 | Yan | 315/185 |
| 5,762,419 | 6/1998 | Yam | 374/2 |
| 5,920,827 | 7/1999 | Baer et al. | 702/3 |
| 5,924,784 | 7/1999 | Chliwnyj et al. | 362/234 |

FOREIGN PATENT DOCUMENTS 22 64 555 9/1993 United Kingdom .

*Primary Examiner*—Don Wong
*Assistant Examiner*—Tuyet T. Vo
*Attorney, Agent, or Firm*—Schnader Harrison Segal & Lewis LLP

[57] ABSTRACT

An LED light string employs a plurality of LEDs wired in a series-parallel block. Further, each series-parallel block may be coupled in parallel, the parallel connection coupled across a supply voltage through an electrical interface. LEDs of the light string may comprise either a single color LED or an LED including multiple sub-dies, each sub-die of a different color. LED series-parallel blocks of the light string may be operated in continuous, periodic or pseudo-random state. The LED light string may provide polarized connectors to couple LED light strings end-to-end and in parallel with the supply voltage. The electrical interface may have one or more parallel outputs and a switch so as to operate multiple LED light strings in continuous, periodic or pseudo-random states. The LED light string may be adapted so as to employ LEDs of different drive voltages in each series section of the series-parallel block. Fiber optic bundles may be coupled to individual LEDs to diffuse LED light output in a predetermined manner.

13 Claims, 3 Drawing Sheets

LED LIGHT STRING EMPLOYING SERIES-PARALLEL BLOCK COUPLING

BACKGROUND OF THE INVENTION

1. Field of the Invention

The present invention relates to light strings, and, more particularly, to light strings employing LEDs.

2. Description of the Related Art

Light emitting diodes (LEDs) are increasingly employed as a basic lighting source in a variety of forms, such as outdoor signage and signaling, replacement light bulbs, or decorative lighting, for the following reasons. First, as a device, LEDs have a longer lifespan than all other standard light sources, particularly common, fluorescent and incandescent sources, with typical LED lifespan, being at least 200,000 hours, as measured by 30% loss of light output degradation over time. Second, LEDs have several favorable physical properties, including ruggedness, cool operation, ability to operate under a wide temperature variation, and safe low-voltage power requirements. Third, newer, more sophisticated doping technologies, increase LED efficiency measured as light output versus power consumed, with efficiencies on the order of ten times that of incandescent lighting. Fourth, LEDs are becoming increasingly cost effective with the increase in applications and resulting volume demand. Fifth, blue LEDs allow full-color or adjustable-color lighting by employing a red/green/blue (RGB) sub-die combination. Sixth, wideband "white" LEDs and related phosphoring technologies allow white LEDs to have a white-light output of good color rendering index without employing a RGB sub-die combination.

LED-based light strings, such as decorative Christmas tree lights, is one such application for LEDs. For example, U.S. Pat. No. 5,495,147 entitled LED LIGHT STRING SYSTEM to Lanzisera (hereinafter "Lanzisara") and U.S. Pat. No. 4,984,999 entitled STRING OF LIGHTS SPECIFICATION to Leake (hereinafter "Leake") describe different forms of LED-based light strings. In both Lanzisera and Leake, exemplary light strings are described employing purely parallel wiring of discrete LEDs with a step-down transformer and rectifier power supply. These light strings of the prior art convert from 110 VAC to DC voltage required to drive a single LED in the string and assume that all LEDs in the light string have the same drive voltage. Further, Leake employs a special LED package with two short, sharpened leads bridging across and penetrating the two soft insulated wires of the light string. Lanzisera employs a complex power supply incorporating not only a step-down transformer and rectifier, but also a zener diode and voltage regulator. In addition, Lanzisera describes connecting multiple strings of LEDs in parallel end-to-end using a polarized connector and regulator to provide constant voltage and current.

SUMMARY OF THE INVENTION

The present invention relates to a light string including a pair of wires; an electrical interface adapted to interface with a standard voltage supply; and a plurality of LEDs electrically coupled in series to form at least one series-parallel block. Each series-parallel block and the electrical interface are electrically coupled in parallel between each wire of the pair.

BRIEF DESCRIPTION OF THE DRAWINGS

Other aspects, features, and advantages of the present invention will become more fully apparent from the following detailed description, the appended claims, and the accompanying drawings in which:

DETAILED DESCRIPTION

In accordance with the present invention, an LED light string employs a plurality of LEDs wired in a series-parallel block. Further, each series-parallel block may be coupled in parallel with one or more additional series-parallel blocks, the parallel connection coupled across a supply voltage through an electrical interface. LEDs of the light string may comprise either a single color LED or an LED including multiple sub-dies each of a different color. Individual LEDs of the light string may be arranged continuously (same color), periodically (multiple, alternating colors) or randomly (any order of multiple colors). The LED light string may provide an electrical interface to couple multiple LED light strings end-to-end in parallel. The electrical interface may have one or more parallel outputs and a switch so as to operate multiple LED light strings in continuous (on), periodic (alternating between on and off) or random (intermittently on) states. The LED light string may be adapted so as to employ LEDs of different drive voltages in each series section of the series-parallel block. Fiber optic bundles may be coupled to individual LEDs to diffuse LED light output in a predetermined manner.

An LED light string of the present invention may have the following advantages. The LED light string may require less power consumption than light strings of incandescent lamps, and may be safer to operate since less heat is generated. The LED light string may have a reduced cost of manufacture by employing series-parallel blocks to minimize the step-down transformer size and cost. In addition, the LED light string may allow efficient coupling of the LED light string to a common DC source, such as 12-V (DC) commonly used in outdoor lighting.

Figure 1:
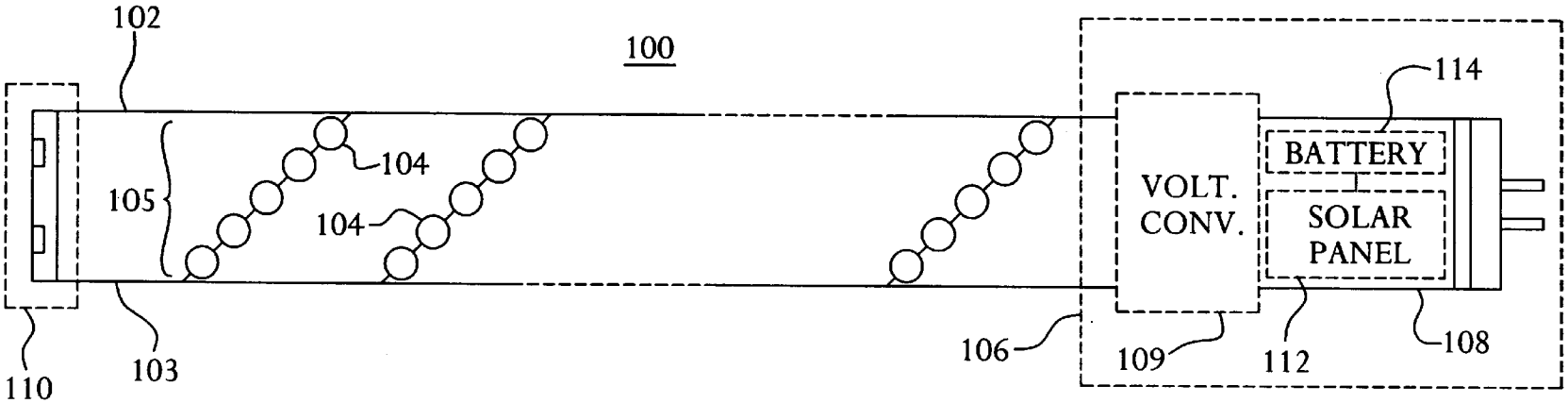
FIG. 1 shows a light string in accordance with the present invention having series-parallel block wiring of a plurality of LEDs.

An embodiment of an LED light string 100 in accordance with the present invention is shown in FIG. 1. LED light string 100 includes a pair of wires 102 and 103, and a plurality of LEDs 104 electrically coupled in series to form LED series-parallel block 105. LED lighting string 100 further includes an electrical interface 106 coupling a supply voltage to an input voltage across the pair of wires 102 and 103. Electrical interface 106 in its simplest form includes a first polarized connector 108, such as a standard 110 VAC wall plug or other polarized connector. Electrical interface 106 may also include a voltage converter 109 to convert the supply voltage to the input voltage, such as converting from 110-V (AC) to 12-V (DC). In addition, an optional second polarized connector 110 may be provided.

LEDs 104 are coupled in series to form the series-parallel block 105 with five LEDs electrically coupled in series between the pair of wires 102 and 103. The number of series-coupled LEDs 104 for the embodiment shown in FIG. 1 is exemplary only; the number of LEDs for the series-parallel block is desirably selected as a maximal number of LEDs wired in series for a desired input voltage. Consequently, in accordance with the present invention, the series-parallel block 105 includes a number of LEDs so as to require the highest input voltage for matching of the input voltage with a DC voltage source. Such DC voltage source may, in addition, be equivalent to a standard DC voltage supply, such as a 12-V (DC) outdoor lighting source, thereby eliminating the need, for example, of additional power supply circuitry.

Also, an LED light string 100 in accordance with the present invention may be directly coupled either to alternating or direct current sources without a voltage conversion. Matching of the desired input voltage of series-parallel block 105 with the supply voltage may be achieved with alternating current sources commonly employed since the supply voltage frequency, such as 60 Hz, is sufficient to provide satisfactory LED operation. Therefore, electrical interface 106 of LED light string 100 has only a polarized connector fitting directly into, for example, a 110 VAC wall socket.

An advantage of maximal series-coupled LEDs may be to minimize the size and cost of a transformer of voltage converter 109, which may be a high-cost component of implementations of the LED light string 100. With a higher input voltage, the current requirement for the light string is reduced, which reduces 1) the required wire gauge of the transformer and 2) the turn-ratio of the step-down transformer.

For example, a 110-Volt supply voltage, which may be a rectified 110-V (AC) signal, is to be applied to 100 LEDs, each LED drawing 20-mAmps at 2 V. If LEDs of the light string are wired purely in parallel such that its input voltage is 2-V (DC), a total current for this purely parallel configuration may be 2-Amps and the turn-ratio of the transformer may be 55:1. With 100 LEDs arranged in 20 series-parallel blocks in accordance with the present invention, each series-parallel block having 5 LEDs, the resulting LED light string input voltage is 10-V (DC), a total current may be only 0.4 Amps, and a turn-ratio in the transformer may be 11:1. Total power consumption remains constant; which for the 100 LED light string is approximately 4 Watts. The transformer in the series-parallel block configuration of the present invention may be smaller, and, therefore, less costly to produce, since both the turn-ratio and wire gauge of the transformer is reduced.

LED light string 100 of, for example 100 LEDs wired together in multiple series-parallel blocks 105. LEDs 104 may be either of a single color (i.e. red, yellow, blue or white), or of a multiplicity of colors. For a multiplicity of colors, LEDs of different colors in a series block may be arranged either periodically or randomly. Further, each series-parallel block 105 may contain a "blinking" LED, which intermittently breaks the series connection of LEDs 104 in the series block 105 so as to blink all the LEDs 104.

Figure 2:
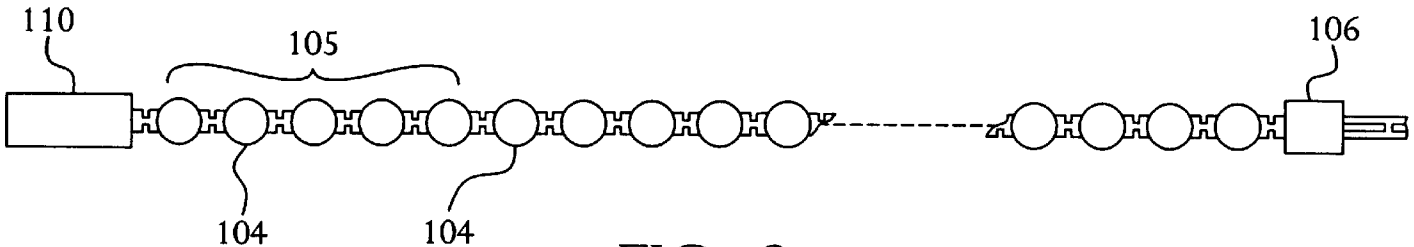
FIG. 2 shows an alternative view of the light string of FIG. 1 having wires twisted and LED series-parallel blocks arranged to space LEDs in a predetermined manner.

Each LED series-parallel block 105 illustrated in FIG. 1 shows five LEDs 104 which may be preferred for a multi-colored string having a single red, yellow, green, orange, and blue LED in each series parallel block 105, where each red, yellow, green and orange LED 104 may operate at 2-V (DC), and each blue LED may operate at 4-V (DC). These operating conditions, result in a required input voltage of 12-V (DC) across the series-parallel block 105. The example of FIG. 2 is illustrative only; for example, in a similar multi-colored LED light string 100 in which blue LEDs are not employed, the LED series block may have up to six LEDs 104 of other colors to achieve a matched input voltage such as 12-V (DC).

If less LEDs 104 are desired than that required to match an input voltage, a series resistor may be employed. In a first case, the series resistor is coupled between one of the wires 102 and 103 and an input voltage terminal of electrical interface 106 to accommodate a lower required input voltage for the entire LED light string 100. In a second case, if a lower required input voltage is required only for selected series-parallel blocks 105, the series resistor is placed in series with the LEDs 104 of the series parallel block 105.

LEDs employed in accordance with the present invention are desirably inexpensive, yet have sufficient brightness and wide viewing angle. In addition, if multiple colors are being used, it is desirable to match the brightness of LEDs so as to be close between colors. An exemplary design employs LEDs for LEDs 104 that may be T1 type, being 5 mm in diameter, and are available from, for example, Kingbright Electronic Co., Ltd. Characteristics of these LEDs are given in Table 1, and each LED in Table 1 is driven at 1.8-V (DC), with each red or green LED consuming 20-mA (3.6-mW) and each orange or yellow LED consuming 10-mA (1.8-mW).

TABLE 1

| Part Number | Source (Die) | Lens Type (Resin) | Luminous Intensity (mCd) | Viewing Angle (deg.) (3 dB B.W.) |
|---|---|---|---|---|
| L-53SSRD/C | S.B.Red (GaAlAs) | Red Diffused | 110–200 | 60 |
| L-53SGD | S.B.Green (GaP) | Green Diffused | 20–60 | 60 |
| L-53ND | Pure Orange (GaAsP) | Orange Diffused | 20–80 | 60 |
| L-53YD | Yellow (GaAsP) | Yellow Diffused | 5–32 | 60 |

Returning to FIG. 1, the present invention comprises electrical interface 106 that may only include a polarized connector 108 to couple the light string directly to a low voltage, for example 12 VDC, power source commonly used for outdoor lighting. In addition, electrical interface 106 may include a solar panel 112 and/or battery 114 allowing the string to be operated by solar and/or battery power.

One embodiment of LED light string 100 may have an electrical interface 106 further comprising multiple outputs terminals wired in parallel. Electrical interface 106 may also have circuitry and an associated external switch (not shown) allowing for either continuous power for continuous LED operation or pseudo-random (intermittent) power for blinking LED operation at each of the multiple output terminal. For this embodiment, multiple pairs of wires 102 and 103 are employed, each having multiple series parallel blocks 105, and each pair of wires 102 and 103 being coupled to a respective output terminal.

However, another embodiment of LED light string 100 may includes pairs of polarized connectors 108 and 110 allowing connection of multiple LED light strings 100 end-to-end. Shown in FIG. 1 are male and female polarized connectors 108 and 110 respectively, shown as standard mini-connectors.

FIG. 2 shows an alternative illustration of the light string of FIG. 1 having twisted wires 102 and 103 and LED series-parallel blocks 105 arranged within the twisted wires 102 and 103 to space LEDs in a predetermined manner. As described with respect to FIG. 1, electrical interface 106 may be only a polarized connector to connect directly to a source voltage, or may include a voltage converter 109. Re-arranged construction of the LED light string 100 as shown in FIG. 2 may be preferred for decorative lighting applications. A preferred embodiment of the present invention may desirably have LEDs coupled to wires and each in a housing similar in appearance to that of a desired application such as decorative (Christmas) light strings. For such an application, the wires 102 and 103 in LED light string 100 may be of a small gauge (e.g., 18-gauge), and of a soft, stranded type twisted together. Such wires 102 and 103 may be twisted together tightly while also being flexible, and insulation may be of a polyurethane compound. LEDs are not necessarily detachable, as the failure rate of each LED is insignificant.

Wires 102 and 103 may be twisted compactly such that the LEDs 104 are approximately evenly spaced. The spacing between LEDs may be between 4 and 5-inches, with a 2-inch spacing from the first or last LED to the first polarized connector 108 and optional second polarized connector 110 if LED light strings 100 are connected end-to-end. Thus, for an LED light string 100 having 100 LEDs, the overall length of the LED light string 100 may be between 33 and 42-feet. Multiple LED light strings 100 may be coupled end-to-end with polarized connectors so as to be electrically coupled in parallel. Proper spacing between each polarized connector and its adjacent LED may be such that, when two strings are connected together, the spacing between the last LED of the first LED light string and the first LED of the second LED light string remains approximately equivalent to the spacing between each LED within an LED light string. Moreover, it is desired for the connection to be made as close as possible to the center of this spacing.

Figure 3:
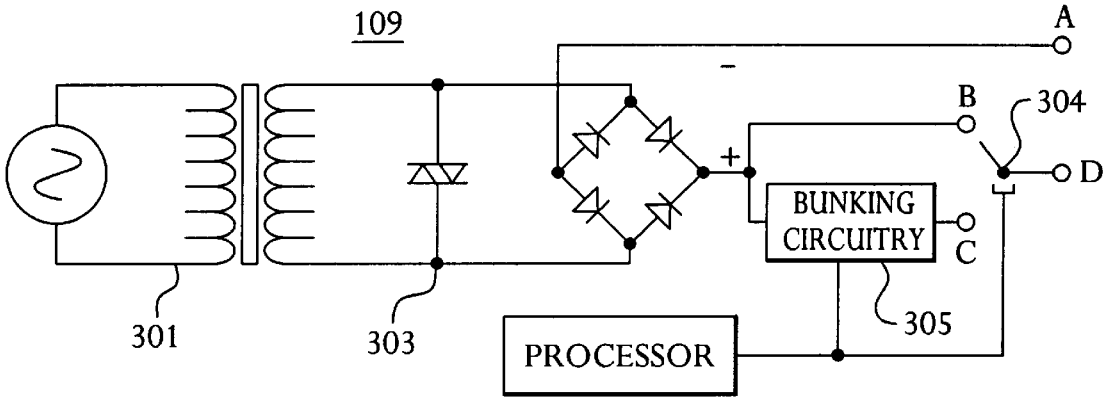
FIG. 3 shows a voltage converter as may be employed by an embodiment of the present invention.

FIG. 3 shows an exemplary voltage converter 109 of FIG. 1. Voltage converter 109 includes transformer 301 followed by a bridge rectifier 302, to convert from an AC voltage to rippled DC voltage at output terminal nodes A and B. Components of voltage converter 109 are designed to handle the maximum power requirements at the transformer/bridge rectifier output (e.g., 10-V, 2-A). A varister 303 may be employed for surge protection. An optional switch 304 and optional pseudo-random blinking circuitry 305 follow bridge rectifier 302. Switch 304 may be employed to select either the output voltage of bridge rectifier 302 or blinking circuitry 305, which selected voltage is provided at node D. Switch 304, therefore, switches the input voltage of series-parallel blocks 105 between a continuous output voltage at terminal B and an intermittent output voltage at terminal C. Optional blinking circuitry may provide independent blinking to multiple parallel output terminals of electrical interface 106. Blinking circuitry 305 may also accommodate maximum matched input voltage and power requirements of the series-parallel blocks 105.

Transformer 301 may be designed such that the maximum number of LED light strings 100 is, for example, 5, resulting in a total of approximately 500 LEDs. Design of the transformer 301 may then be based on the resulting computed power required for the LED light strings. For example, 100 T1-type, 5-mm LEDs may be employed in 5 LED light strings 100, with each LED series-block 105 having 5 LEDs and LEDs 104 are either a single color or a periodic series of four colors such as red, yellow, green, and orange. If each LED draws 20-mAmps at 2-V and the output voltage of the transformer provides the required input voltage of 10-V(DC) for the maximum number of five strings, then the maximum current output of the transformer is 2-Amps, resulting in a maximum power consumption of 20-W.

A zener diode and voltage regulator may alternatively be employed with the transformer 301. However, the source voltage, i.e., 110 VAC is generally tightly controlled, and LEDs 104 have fairly large capacity to handle voltage surges. For example, LED drive voltages may be increased significantly above their operating voltage before burnout, particularly if the selected operating voltage is somewhat below the nominal operating voltage.

Electrical interface 106 may in addition be provided with a processor, such as a micro-controller, to control aspects of voltage converter 109. For example, as shown in FIG. 3, the processor may implement steps of a program controlling the position of switch 304. Further, since multiple LEDs light strings 100 may be connected in parallel, the processor may be employed with a separate terminal switch to switch the output voltage of the transformer 301 between each LED light string 100 to produce a predetermined effect.

Figure 4A:
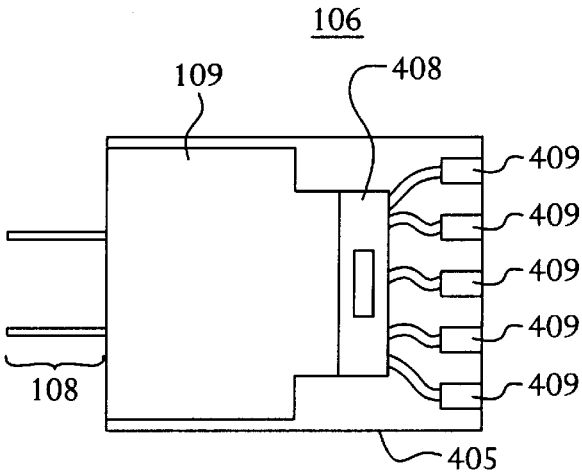
FIG. 4A shows a top view of a generalized power supply with controlled output signals for the light string of FIG. 1.
Figure 4B:
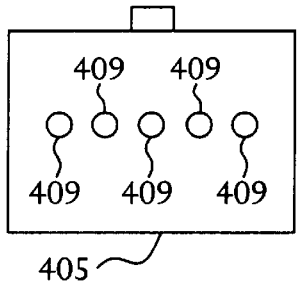
FIG. 4B shows a front view of a generalized power supply with controlled output signals for the light string of FIG. 1.

LED lighting string 100 may include a separately packaged electrical interface having voltage converter 109, such as that shown in FIG. 3, and polarized connector 108 for indoor/outdoor use (FIG. 1). FIGS. 4A and 4B show top and side views, respectively, of an exemplary, separately packaged, voltage converter 109 configured as a "plug-in" power supply. Supply housing 405 may be manufactured of a durable material, such as polycarbonate or polypropylene. Polarized connector 108 is coupled to the input terminal pair of a transformer of voltage converter 109, and polarized connector 108 may preferably be a standard 12-V (DC) or 110-V (AC) wall plug. The output terminal pair 408 of the voltage converter 109 is coupled to multiple output terminal jacks 409, each terminal jack providing the output voltage across two nodes. Consequently, multiple pairs of wires 102 and 103 for LED light string 100 (FIG. 1) may be coupled to nodes of corresponding ones of the multiple output terminal jacks 409.

Figure 7:
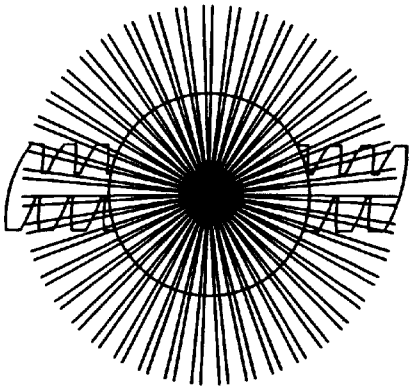
FIG. 7 shows a top view of an LED having a fiber-optic bundle as shown in FIG. 6.
Figure 6:
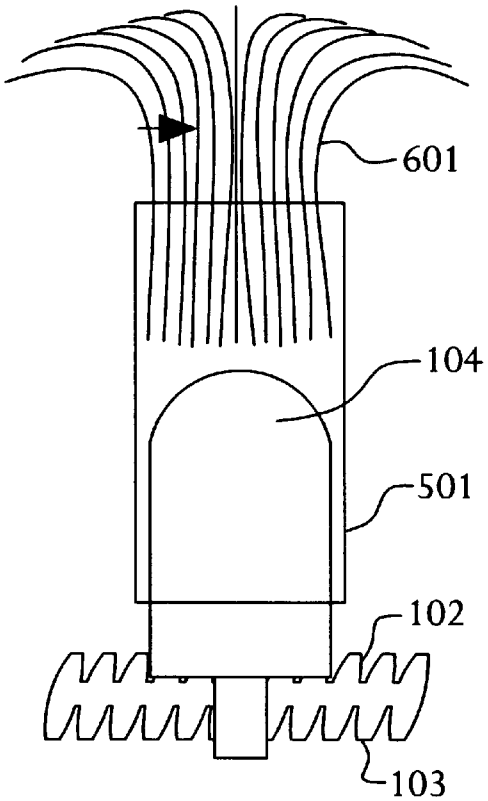
FIG. 6 shows a side view of one LED in an LED light string in accordance with the present invention having a fiber-optic bundle coupled to the housing of the LED.
Figure 5:
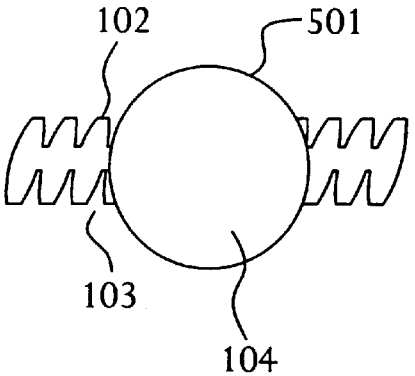
FIG. 5 shows a top view of one LED in a LED light string in accordance with the present invention having the LED mounted in a housing.

FIG. 5 shows a single LED 104 of the LED lighting string coupled to the wiring 103 and 103 in a housing 501, which housing may be constructed of a durable plastic material such as polycarbonate or polypropylene. FIG. 6 and FIG. 7 show top and side views, respectively, of an exemplary fiber-optic bundle 601 that may be fitted into the housing 501 for diffusing the LED light output of LED 104. Fiber-optic bundle 601 may be composed of a semi-rigid durable plastic, such as heat-shrinkable tubing. Housing 501 may be formed in a semi-rigid manner so that it may be removably fastened to the LED, and in a preferred embodiment the housing 501 is fastened without the adhesives or other mechanical design. The fiber-optic bundle as illustrated in FIGS. 6 and 7 is a "puff" configuration extending from the housing 501 by, for example, approximately 2 to 3-inches. Each fiber in the puff may be manufactured to curve outward from the center in a radial pattern, producing a dramatic lighting effect. Although the puff bundle may be preferred for some applications, many other fiber-optic designs may be used, including an icicle configuration or a star configuration. An exemplary puff design comprises approximately 75 strands of 0.02 inch plastic fiber, enough to fill a housing having 5 mm inner diameter.

It will be understood that various changes in the details, materials, and arrangements of the parts which have been described and illustrated in order to explain the nature of this invention may be made by those skilled in the art without departing from the principle and scope of the invention as expressed in the following claims.

What is claimed is:

1. A light string comprising:

a pair of wires;

an electrical interface adapted to interface with a standard voltage supply;

a plurality of LEDs electrically coupled in series to form at least one series-parallel block, wherein each series-parallel block and the electrical interface are electrically coupled in parallel between each wire of the pair; and wherein the electrical interface further includes a voltage converter, the voltage converter adapted to convert a first voltage potential of the standard voltage supply to a second voltage potential across a pair of output terminals and between each wire of the pair; and wherein the voltage converter includes a transformer to convert between the first and second voltage potentials, and a ratio of the first and second voltage potentials being matched to an input voltage of the series-parallel block; and wherein the voltage converter includes at least two pairs of output terminals, each pair of output terminals providing the second voltage potential between the corresponding terminals, and the LED light string further comprises at least two pairs of wires, each pair of wires coupled to a respective pair of output terminals and at least one series-parallel block being electrically coupled between each pair of wires.

2. The invention as recited in claim 1, wherein each LED of the plurality of LED has a drive voltage, and a number of LEDs of the series parallel block being selected based on the drive voltage of each LED so as to match the input voltage of the series block with the second voltage potential.

3. The invention as recited in claim 1, wherein the voltage converter includes a bridge rectifier coupled in parallel across a pair of output terminals of the transformer, the output terminal pair being the output terminals of the bridge rectifier, the voltage converter converting from a first voltage potential having an alternating current to a second voltage potential across the output terminal pair having a direct current.

4. The invention as recited in claim 1, wherein the series-parallel block includes a blinking LED, the blinking LED intermittently breaking the electrical coupling of the plurality of LEDs.

5. The invention as recited in claim 1, wherein the LED light string further includes a polarized connector coupled between each of the pair of wires, and an electrical interface of another LED light string being electrically coupled to the polarized connector so as to couple each LED light string end-to-end in parallel to the supply voltage.

6. The invention as recited in claim 1 wherein the electrical interface further includes a solar panel and a battery, the solar panel adapted to charge the battery so as to maintain the standard voltage supply.

7. The invention as recited in claim 1, wherein a resistor is electrically coupled in series with the plurality of LEDs and is electrically coupled between the input voltage of the series-parallel block and the second voltage potential so as to match the input voltage of each series-parallel block with the second voltage potential.

8. The invention as recited in claim 7, wherein the resistor is electrically coupled in series with the plurality of LEDs of a series-parallel block to electrically couple the resistor between the pair of wires.

9. The invention as recited in claim 1, wherein the voltage converter comprises:

a transformer to convert between the first and second voltage potentials;

a blinking circuit adapted to provide an intermittent voltage from the second voltage potential; and a switch adapted to select either of two nodes, one node providing the second voltage potential from the transformer to the pair of wires, and the other node providing the intermittent voltage from the blinking circuit to the pair of wires.

10. The invention as recited in claim 9, wherein the voltage converter further comprises a processor adapted to select the position of the switch based on a predetermined algorithm.

11. The invention as recited in claim 1, wherein each LED of the plurality LEDs has a corresponding light output color, and the plurality of LEDs either being of a single color or multiple colors.

12. The invention as recited in claim 11, wherein the plurality LEDs being arranged such that, for multiple colors, each LED color of the plurality of LEDs appears either periodically or pseudo-randomly.

13. The invention as recited in claim 11 wherein at least one LED includes a housing, a fiber-optic bundle removeably mounted to the housing so as to diffuse a light output of the LED through the fiber-optic bundle.

* * * * *